US007556752B1

(12) United States Patent
Hicks

(10) Patent No.: US 7,556,752 B1
(45) Date of Patent: Jul. 7, 2009

(54) MULTI-SECTIONAL FORM FOR FORMING BASES FOR LIGHT POLES

(76) Inventor: Gregg Hicks, 4709 Latimer Rd., Raleigh, NC (US) 27609

( * ) Notice: Subject to any disclaimer, the term of this patent is extended or adjusted under 35 U.S.C. 154(b) by 537 days.

(21) Appl. No.: 11/414,846

(22) Filed: May 1, 2006

(51) Int. Cl.
*E04B 1/16* (2006.01)
*H05B 3/30* (2006.01)
*B41B 11/60* (2006.01)

(52) U.S. Cl. ..... 264/32; 249/165; 264/272.12

(58) Field of Classification Search ..... 264/35, 264/31, 272.12; 52/741.14, 742.14, 742.15; 249/48, 163, 165; 405/222, 256, 257
See application file for complete search history.

(56) References Cited

U.S. PATENT DOCUMENTS

| | | | | |
|---|---|---|---|---|
| 2,093,346 | A * | 9/1937 | Badt | 264/35 |
| 3,990,672 | A * | 11/1976 | Buchanan | 249/48 |
| 4,033,548 | A * | 7/1977 | Shahar | 249/194 |
| 4,767,095 | A | 8/1988 | Fitzgerald et al. | |
| 4,854,542 | A | 8/1989 | Pruett | |
| 4,978,099 | A | 12/1990 | Carlson | |
| 5,178,887 | A | 1/1993 | O'Connor et al. | |
| 5,255,888 | A | 10/1993 | Workman | |
| 5,337,534 | A * | 8/1994 | Nasca | 52/745.21 |
| 5,740,645 | A | 4/1998 | Raby | |
| 6,167,673 | B1 * | 1/2001 | Fournier | 52/848 |
| 6,676,102 | B1 | 1/2004 | Hambelton | |
| 6,705,058 | B1 | 3/2004 | Foust et al. | |
| 6,723,282 | B1 | 4/2004 | Chu et al. | |
| 6,851,838 | B2 | 2/2005 | Haddad et al. | |
| 6,912,408 | B1 | 6/2005 | O'Neill et al. | |
| 6,997,427 | B2 | 2/2006 | Manthei | |
| 2005/0110197 | A1 | 5/2005 | Deffense | |

* cited by examiner

*Primary Examiner*—Christina Johnson
*Assistant Examiner*—Benjamin Schiffman
(74) *Attorney, Agent, or Firm*—Coats & Bennett, P.L.L.C.

(57) ABSTRACT

A multi-sectional form includes first and second half-cylindrical sections with each section having opposed edges. The cylindrical sections are secured together by two elongated generally H-shaped connectors, each connector including a pair of opposed generally U-shaped grooves. The first and second cylindrical sections are connected together by inserting one edge of one section and one edge of another section into the opposed U-shaped grooves of one H-shaped connector. One or more bands are secured around the exterior of the sections to secure and hold the sections together.

12 Claims, 6 Drawing Sheets

MULTI-SECTIONAL FORM FOR FORMING BASES FOR LIGHT POLES

FIELD OF THE INVENTION

The present invention relates to concrete forms, and more particularly to a multi-sectional form and a method for forming concrete bases for light poles.

BACKGROUND

Light poles are typically secured to a concrete base that extends downwardly into the ground. Once the base has been formed, a light pole is secured to the base and extends upwardly therefrom. Bases for light poles must be substantial to support the weight of the light pole. Furthermore, because light poles are typically placed in locations where there is vehicular traffic, it is important that they be robust and able to withstand impacts from vehicles. Moreover, it is desirable for the bases for light poles to be aesthetically pleasing.

Typically, bases for light poles are formed by utilizing a disposable corrugated board tube. Since the corrugated board tube is disposable, it can only be used to form one base and hence is relatively expensive. Further, these corrugated tubes must be disposed of after use and that in and of itself is time consuming.

SUMMARY

The present invention entails a method of forming a base for a light pole. The method entails excavating a hole or cavity in the earth and assembling a multi-sectional form having a top and bottom. The multi-sectional form is inserted into the hole in the earth such that the bottom of the form terminates short of the bottom of the hole and such that a substantial portion of the multi-sectional form extends above ground or earth level. Thereafter, concrete is poured in the multi-sectional form and after the concrete is cured and hardened, the multi-sectional form is removed from the formed concrete base. Thereafter, a light pole can be secured to the base.

In addition, the present invention entails a multi-sectional form for forming concrete bases and columns. This multi-sectional form comprises at least two partial cylindrical or curved sections that are secured together by an elongated strip having opposed slots or grooves for receiving edges of the respective sections. The edges of the respective sections are inserted into the elongated grooves or slots of the connector so as to connect the two sections together. Optionally, there is provided one or more bands that extend exteriorly around the sections for holding the sections together.

In one embodiment, the sections of the form are made from a light weight flexible material such as an aluminum composite.

Other objects and advantages of the present invention will become apparent and obvious from a study of the following description and the accompanying drawings which are merely illustrative of such invention.

DESCRIPTION OF THE INVENTION

Figure 1:
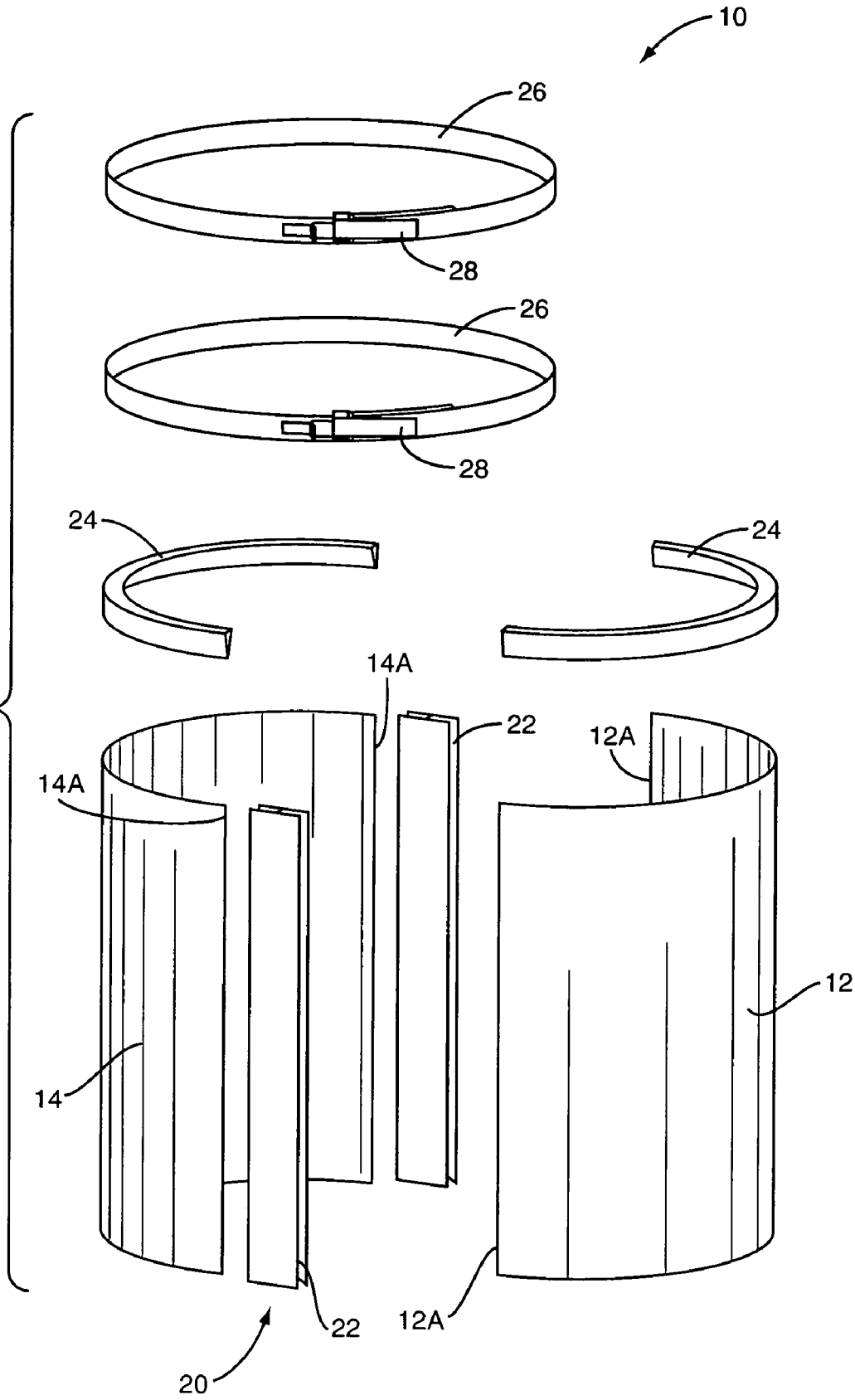
FIG. 1 is an exploded view of the multi-sectional concrete form of the present invention.

With further reference to the drawings, a multi-sectional concrete form is shown therein and indicated generally by the numeral 10. In one embodiment, form 10 comprises a first half cylindrical section 12 and a second half cylindrical section 14. Partial cylindrical sections 12 and 14 can be connected together to form a column shaped form. Each cylindrical section includes a pair of opposed edges. That is, half cylindrical section 12 includes opposed edges 12A while half cylindrical section 14 includes opposed edges 14A.

Each section 12 and 14 can be constructed of various materials. However, in a preferred embodiment it is contemplated that each section 12 and 14 is generally rigid. That is, each section 12 or 14 comprises a sheet of relatively thin, flexible material that can be curved and shaped to conform to the general shape of the form 10. As noted above, various materials can be used for the sections 12 and 14. However, in one embodiment it is contemplated that the material would comprise an aluminum composite, that is a core material disposed between two thin sheets of aluminum. Other composites and alloys can be used. For example, the material may be constructed of brushed aluminum, titanium, copper, stainless steel or composites where the titanium, stainless steel, copper or brushed aluminum would comprise a pair of sheets spaced across a core. In addition, an alloy, such as a titanium-zinc alloy may be used. Alcoa manufactures or produces a line of cladding product under the trademark Reynobond. Many of the Alcoa Reynobond™ products could be used to form the sections 12 and 14 of the mold. In addition, the sections 12 and 14 could be constructed of fiberglass.

Figure 2:
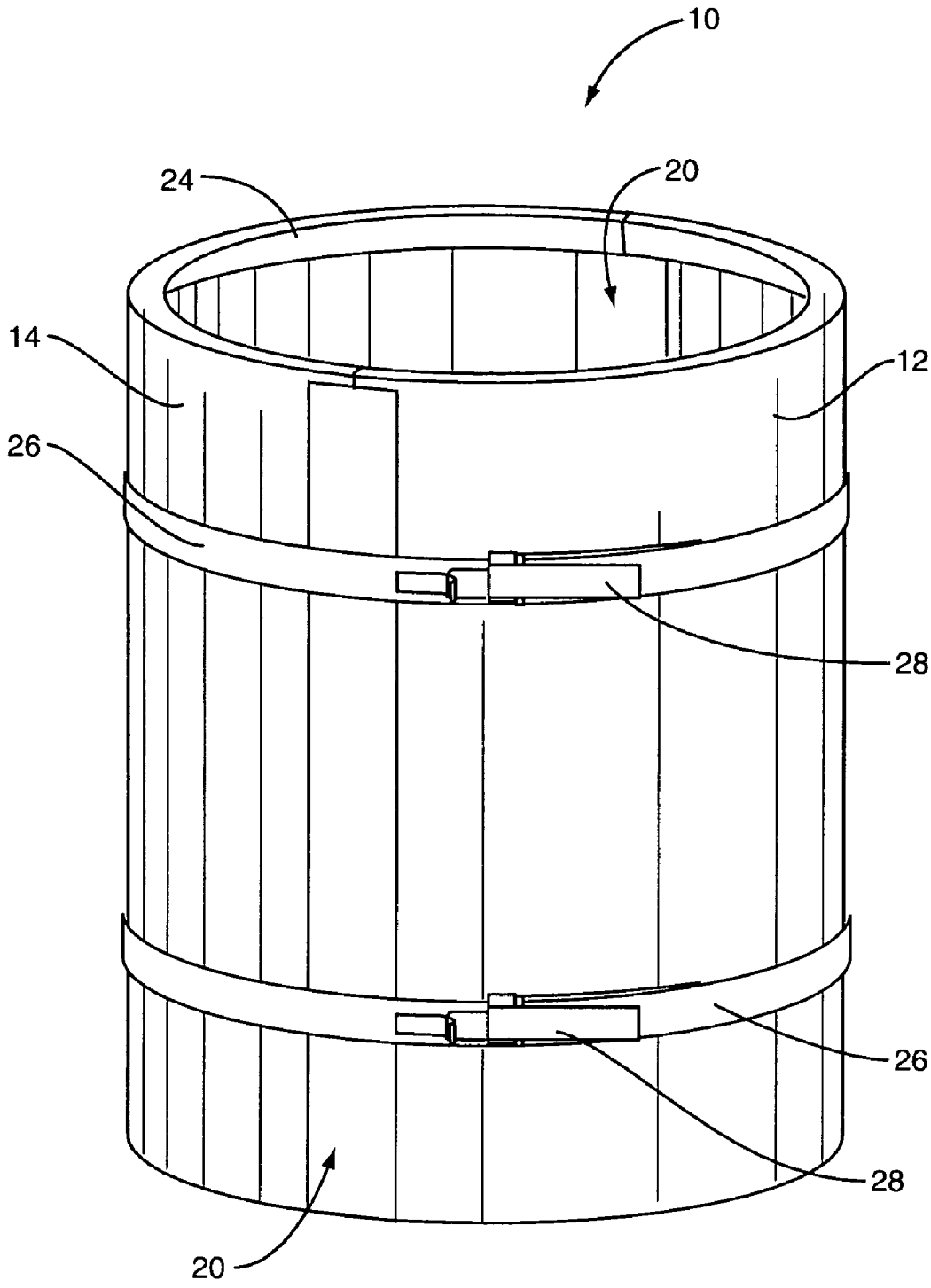
FIG. 2 is a perspective view of the multi-sectional form shown in an assembled configuration.

The half cylindrical sections 12 and 14 are connected by an elongated connector indicated generally by the numeral 20. As shown in the drawings, connector 20 assumes a generally H shape and includes a pair of opposed U-shaped grooves or slots 22. As seen in the drawings, the opposed edges 12A and 14A of the sections 12 and 14 are inserted into the U-shaped grooves or slots 22 that are formed on opposite sides of the elongated connector 20. The U-shaped grooves or slots 22 can be configured to result in a frictional fit with the edges 12A and 14A of the sections 12 and 14. That is, edges 12A and 14A can be inserted into the U-shaped slots 22 and the width of the respective slots or grooves is such that a frictional fit is achiever. Note in FIG. 2 that when the form 10 is assembled that the elongated connectors 20 extend from the bottom to the top of the form.

In order to place an aesthetically pleasing chamfer on a base or column, the mold 10 is provided with a rubber insert 24. Rubber insert 24 in the case of this embodiment is shown as a two-piece construction, but it is understood that the same could be a single piece. In any event, the inner edge of the rubber insert 24 is beveled such that it will form a circumferential chamfer around the top portion of a concrete base formed by the form 10. Rubber insert 24 can be secured in various ways to the form 10, but in one embodiment a series of screws are screwed through the sections 12 and 14, from the exterior, into the rubber insert 24. This results in the rubber insert 24 being held around the upper, inner edge of the form.

To secure the sections 12 and 14 together, there is provided a pair of adjustable bands 26. Bands 26 can assume various forms from fabric bands to metal bands. In the embodiment illustrated herein, the bands are metal bands and are adjustable through an over center latch 28. The bands will be designed such that in an unlocked position the respective bands would be of a sufficient diameter to clear the sections 12 and 14. Once the over center latch is actuated and the band 26 moved to the locked position, the circumference of the respective bands will decrease and the bands will provide a force generally uniformly around the exterior of the form 10. This results in the band forcing the two cylindrical sections 12 and 14 towards each other and generally maintains the edges 12A and 14A of the sections 12 and 14 in the connector 20.

Turning to FIGS. 3-5B, there is illustrated therein a process for forming a light pole base. The multi-sectional form 10 of the present invention can be utilized to form bases and columns of all types. However, the form 10 is particularly described herein in connection with a method or process for forming a base for a light pole.

Figure 3:
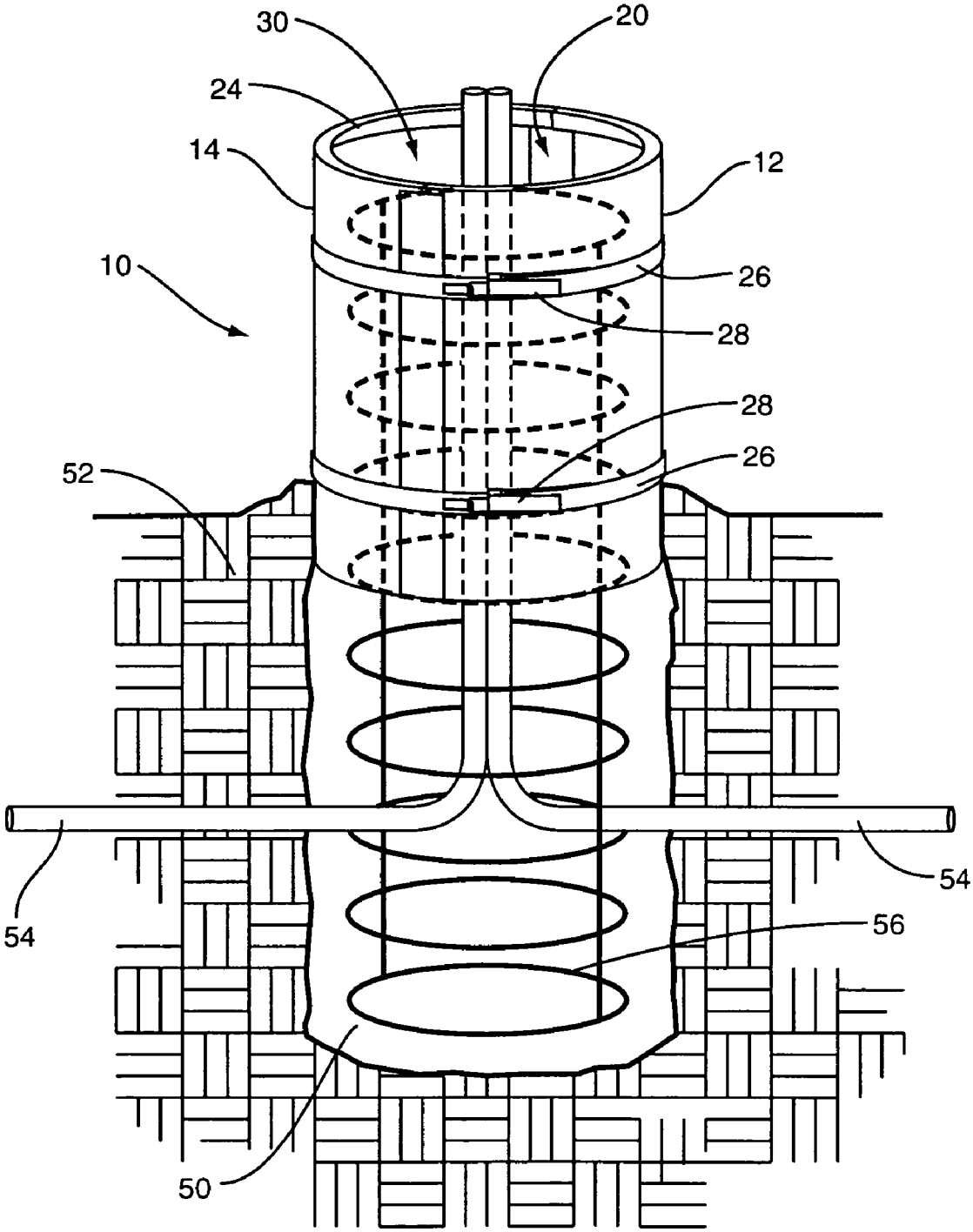
FIG. 3 is a vertical cross-sectional view showing the multi-sectional form of the present invention being utilized to form a base for a light pole.

With reference to FIG. 3, an opening or hole 50 is excavated in the ground 52. In most cases, the hold 50 is bored with an auger. The diameter of the hole 50 can vary, but in many applications will have a diameter of 18" to 36". The depth of the hold 50 can also vary, and in many cases will range from approximately 4' to approximately 8'. Typically, electrical conduit disposed underground will lead to the hole and function to direct electricity to the light associated with the light pole. In this case, as viewed in FIG. 3, two electrical conduits 54 extend underground to the hole 50.

Once the hole 50 has been dug, the multi-sectional form 10 described above is assembly and inserted into the hole. Note in FIG. 3 that the diameter of the hold 50 and the diameter of the form 10 are about equal. In any event, the form 10 is inserted into the hole 50 such that it extends only partially down into the hole. The lower portion of the form 10 terminates short of the bottom of the hole. In many cases, for example, the form 10 will be inserted only approximately 8" to 12" into the hole 50. Many times, earth will be backfilled into the area lying around the form 10 near the base of the hole. In some cases as illustrated in FIG. 3, a mound of dirt is pulled and packed around the form 10 in the area where the form 10 meets ground level.

Figure 4:
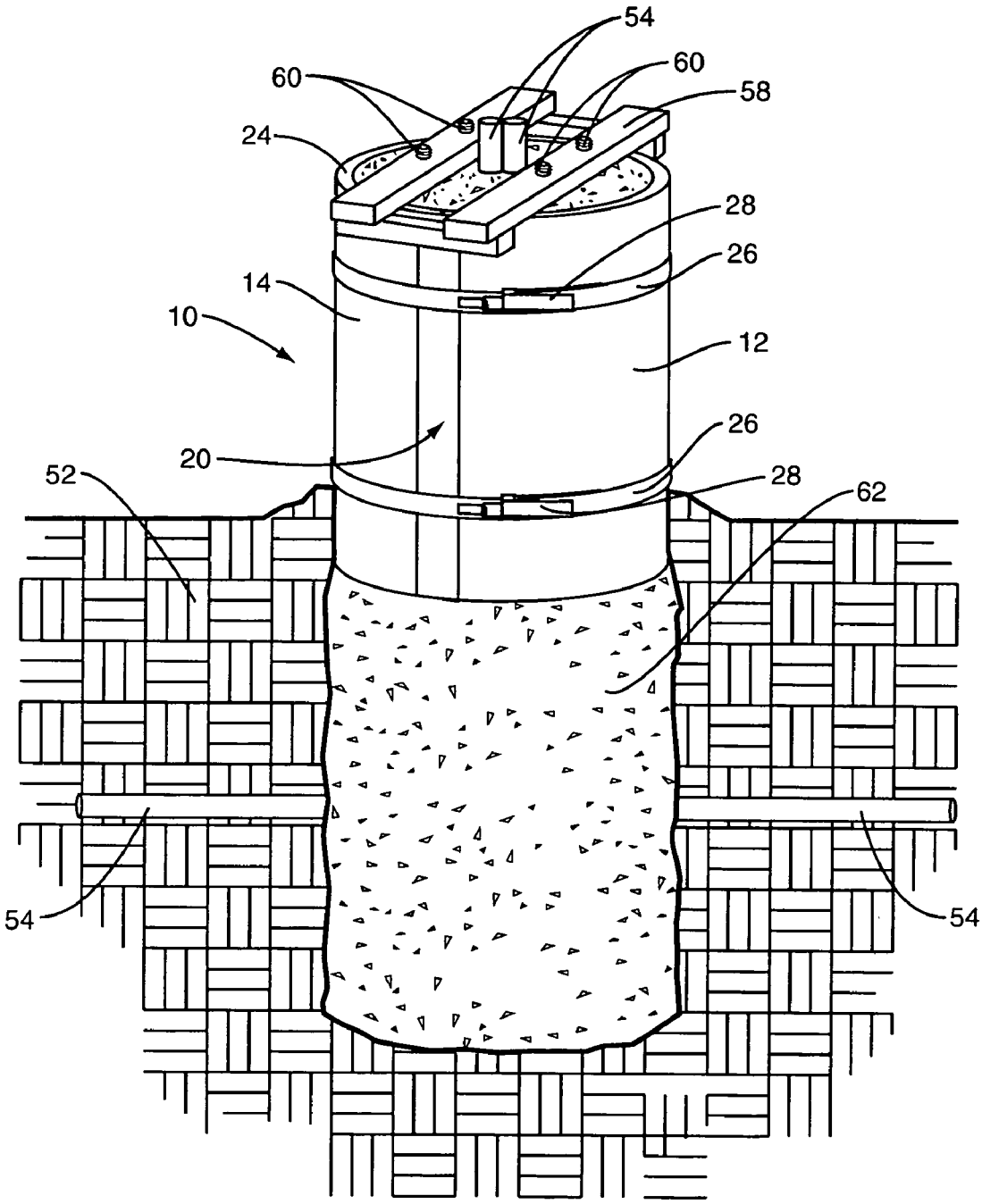
FIG. 4 is a view similar to FIG. 3 but showing the form extending around a portion of the concrete base.
Figure 5A:
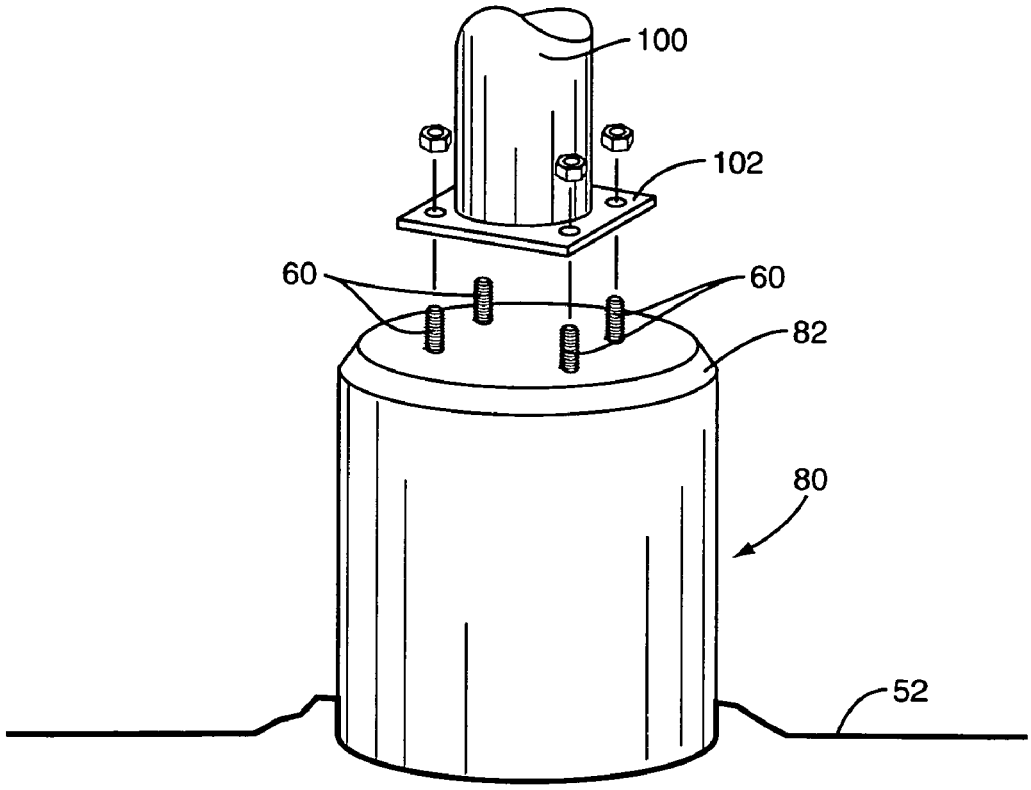
FIGS. 5A and 5B illustrate the base of a light pole being secured to the concrete base.
Figure 5B:
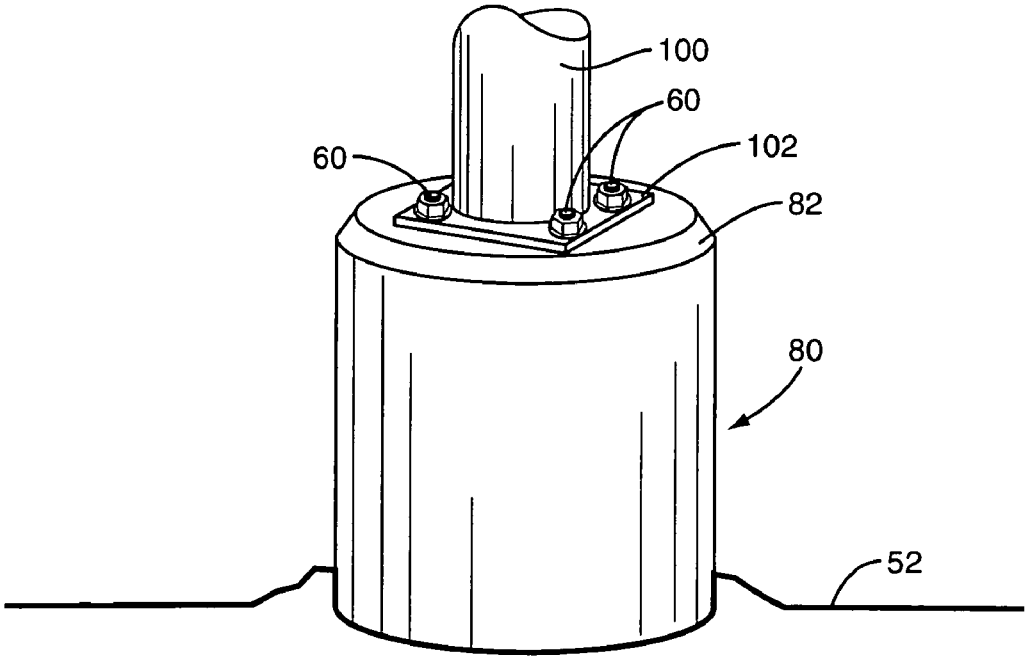

Prior to inserting the form 10 into the hole 50, a network of rebar 56 is placed in the hole. The rebar 56 will generally extend from the bottom of the hole 50 upwardly to a height just below the top of the form 10 when the form is inserted. Various rebar configurations can be utilized to meet local code requirements. Once the form 10 has been set as shown in FIG. 3, an anchor bolt holder 58 is supported or placed over the top of the form 10. Note that the anchor bolt holder 58 is shown in FIG. 4 and would be placed on the form 10 prior to pouring concrete into the form and into the underlying hole 50. Secured within the anchor bolt holder 58 is a series of anchor bolts with their threaded ends projecting upwardly from the form and exposed.

Figure 6:
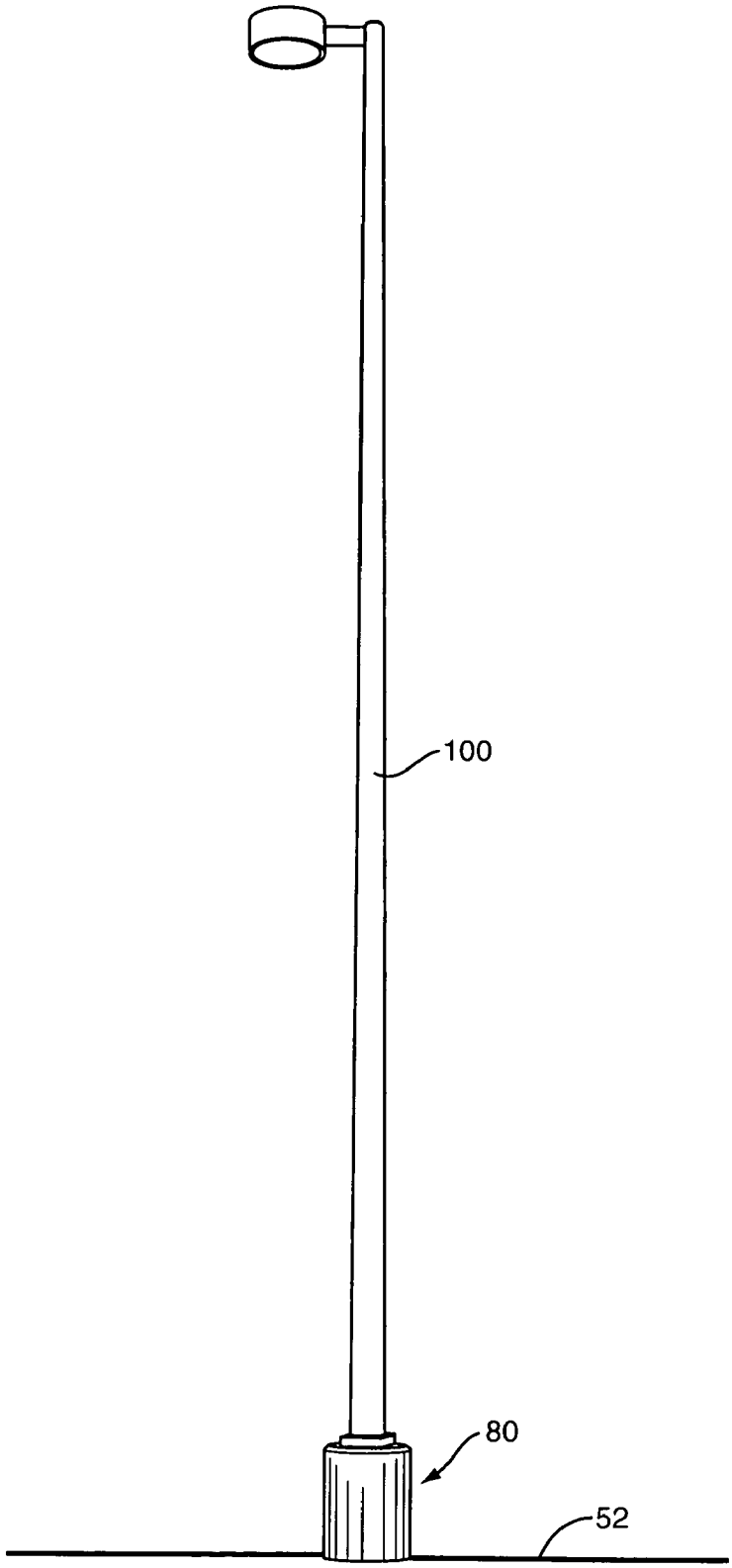
FIG. 6 is a side elevational view showing a light pole secured to the formed concrete base.

At this point, the concrete base is formed by pouring concrete through the form and into the underlying hole 50. As the hole is filled, the concrete will naturally rise in the form 10. The concrete is poured to a level approximately equal to the top of the rubber insert 24. This will leave the upper ends of the anchor bolts 60 exposed. After the concrete is poured, it is allowed to harden and cure. Once the concrete 62 has hardened, the anchor bolt holder 58 is removed, leaving the threaded ends of the anchor bolts 60 exposed. Thereafter, the form 10 is disassembled. This is accomplished by actuating the over center latches 28 by moving them from the locked position to the unlocked position. Then, the bands 26 are removed from the form 10. After the bands 26 have been removed, the individual sections 12 and 14 of the form 10 can be separated or pulled from the elongated connectors 20. After the form 10 has been disassembled, the sections 12,14 can be nested together and transported to the next job or to a storage site. This leaves the concrete base, indicated generally by the numeral 80 and shown in FIGS. 5A, 5B and 6. Note the chamfered edge 82 surrounding the top portion of the base 82. A light pole 100 can now be installed on the base. Note that light pole 100 would typically include a bottom bracket 102 having holes formed therein to align with the anchor bolts 60. Once the bottom bracket 102 has been inserted over the anchor bolts 60, threaded nuts can be secured to the anchor bolts so as to secure the light pole 100 to the base 80.

In the above discussion, the multi-sectional form 10 has been discussed in the context of a method for forming a base for a light pole. It is to be understood that the multi-sectional form 10 of the present invention can also be used to form other bases and columns.

The multi-sectional form 10 of the present invention has many advantages. The form is constructed of lightweight material that can be easily handled and transported from job to job and in those cases where the material is formed from a lightweight composite such as an aluminum composite, the inner surface that bears against the concrete is relatively smooth and slick. This facilitates removing the form 10 from a formed base.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A method of forming a base for a light pole, comprising:

forming a hole in ground;

assembling a multi-sectional form having a top and a bottom wherein the multi-sectional form includes at least first and second curve sections with each curve section having opposite edges;

assembling the multi-sectional form including connected the first and second curve sections together with at least first and second elongated H-shape connectors with each H-shape connector including first and second slots extending along opposite edges of the H-shape connector;

connecting the first and second curve sections together including inserting the edges of the first curve section into the first slots of the first and second H-shape connectors, and inserting the edges of the second curve section into the second slots of the first and second H-shape connectors such that the first and second H-shape connectors extend between edges of the first and second curve sections;

securing the first and second curve sections together with one or more bands that extend circumferentially around the first and second curve sections;

inserting the multi-sectional form into the hole such that a substantial portion of the multi-sectional form extends above the ground;

threading at least one electrical conduit upwardly through the bottom of the form and out the top of the form;

setting one or more anchor bolts in the top portion of the form;

pouring concrete in the multi-sectional form and in the underlying hole and permitting the concrete to harden;

removing the multi-sectional form and leaving a light pole base extending upwardly from the ground; and wherein a light pole can be secured to the base by attaching a lower bracket associated with the light pole to the anchor bolts extending upwardly from the concrete light pole base.

2. The method of claim 1 wherein the one or more bands are metal bands.

3. The method of claim 1 wherein setting the anchor bolts comprises disposing an anchor bolt holding assembly over the multi-sectional form and supporting the anchor bolts in the anchor bolt holding assembly.

4. The method of claim 1 wherein assembling the multi-sectional form includes utilizing a plurality of curved sections made of an aluminum composite.

5. The method of claim 1 wherein assembling the multi-sectional form includes utilizing a plurality of curved sections made of material taken from the group comprising aluminum, aluminum composite, titanium, titanium composite, titanium-zinc alloy, copper, copper composite, stainless steel, and stainless steel composite.

6. The method of claim 1 where the one or more bands includes an over-center latch, and the method includes tightening the one or more bands around the first and second curve sections by actuating the over-center latch and moving the over-center latch from and unlock position to a lock position.

7. A method for forming a concrete base, comprising:

forming a hole in the ground;

assembling a multi-sectional form having a top and a bottom wherein the multi-sectional form includes at least first and second curve sections with each curve section having opposite edges;

assembling the multi-sectional form including connected the first and second curve sections together with at least first and second elongated H-shape connectors with each H-shape connector including first and second slots extending along opposite edges of the H-shape connector;

connecting the first and second curve sections together including inserting the edges of the first curve section into the first slots of the first and second H-shape connectors, and inserting the edges of the second curve section into the second slots of the first and second H-shape connectors such that the first and second H-shape connectors extend between edges of the first and second curve sections;

securing the first and second curve sections together with one or more bands that extend circumferentially around the first and second curve sections;

inserting the multi-sectional form into the hole such that a substantial portion of the multi-sectional form extends above the ground;

pouring concrete into the multi-sectional form and into the hole in the ground and permitting the concrete to harden; and removing the multi-sectional form and leaving a concrete base extending upwardly from the ground.

8. The method of claim 7 where the one or more bands includes an over-center latch, and the method includes tightening the one or more bands around the first and second curve sections by actuating the over-center latch and moving the over center latch from and unlock position to a lock position.

9. The method of claim 7, wherein the one or more bands are metal bands.

10. The method of claim 7, including setting one or more anchor bolts in the top portion of the form, and wherein sitting the anchor bolts comprises disposing an anchor bolt holding assembly over the multi-sectional form and supporting the anchor bolts in the anchor bolt holding assembly.

11. The method of claim 7 wherein assembling the multi-sectional form includes utilizing a plurality of curved sections made of an aluminum composite.

12. The method of claim 7 wherein assembling the multi-sectional form includes utilizing a plurality of curved sections made of material taken from the group comprising aluminum, aluminum composite, titanium, titanium composite, titanium-zinc alloy, copper, copper composite, stainless steel, and stainless steel composite.

* * * * *